United States Patent [19]

Quattlebaum

[11] 4,136,205

[45] Jan. 23, 1979

[54] CONTAINER AND METHOD FOR PACKAGING MEAT ARTICLES

[75] Inventor: Robert W. Quattlebaum, Lyman, S.C.

[73] Assignee: W. R. Grace & Co., Duncan, S.C.

[21] Appl. No.: 782,818

[22] Filed: Mar. 30, 1977

[51] Int. Cl.[2] ..... B65B 53/02; B65D 33/02

[52] U.S. Cl. ..... 426/412; 53/434; 206/524.2; 206/524.3; 206/524.8; 206/497; 229/55; 426/127; 426/129

[58] Field of Search ..... 426/106, 124, 129, 127, 426/410, 412; 206/497, 524.2, 524.3, 524.8, 594; 229/55; 53/22 B

[56] References Cited

U.S. PATENT DOCUMENTS

| | | | |
|---|---|---|---|
| 2,237,277 | 4/1941 | Williams et al. | 99/174 |
| 2,415,387 | 2/1947 | Graebner | 206/46 |
| 2,674,509 | 4/1954 | Barnet | 426/124 |
| 2,779,681 | 1/1957 | Sell et al. | 99/174 |
| 2,860,990 | 11/1958 | Guthrie | 99/107 |
| 2,891,870 | 6/1959 | Selby et al. | 99/174 |
| 2,962,158 | 11/1960 | Struthers | 206/46 |
| 3,209,978 | 10/1965 | Dupuis | 229/14 |
| 3,264,165 | 8/1966 | Stickel | 428/310 X |
| 3,317,038 | 5/1967 | Bade et al. | 206/62 |
| 3,342,613 | 9/1967 | Schelhorn | 426/127 X |
| 3,460,740 | 8/1969 | Hagen | 229/53 |
| 3,494,457 | 2/1970 | Titchenal | 229/55 X |
| 3,559,800 | 2/1971 | Butler | 229/66 |
| 3,625,348 | 12/1971 | Titchenal | 206/484 |
| 3,685,720 | 8/1972 | Brady | 229/66 |
| 3,741,253 | 6/1973 | Brax | 428/315 |
| 3,768,724 | 10/1973 | Hill | 229/53 |
| 3,948,436 | 4/1976 | Bambara | 229/55 |
| 3,983,258 | 9/1976 | Weaver | 426/307 |

FOREIGN PATENT DOCUMENTS

| | | | |
|---|---|---|---|
| 2335127 | 1/1974 | Fed. Rep. of Germany | 426/412 |

OTHER PUBLICATIONS

Modern Plastics 4/68, pp. 93–96.

*Primary Examiner*—Steven L. Weinstein
*Attorney, Agent, or Firm*—John J. Toney; William D. Lee, Jr.; John B. Hardaway

[57] ABSTRACT

A tear and puncture resistant container for use in packaging meat products having protruding bone sections. The container is multilayer having an outer body portion of a flexible packaging material and an inner layer of puncture resistant material disposed between the meat product and the outer layer.

14 Claims, 2 Drawing Figures

CONTAINER AND METHOD FOR PACKAGING MEAT ARTICLES

BACKGROUND OF THE INVENTION

This invention relates generally to the art of packaging and more particularly to a new puncture resistant package for meat articles having sections of protruding bone therein.

The use of heat shrinkable plastic as a flexible packaging material for various food stuffs including meats has become common place in today's distribution system. Such plastic materials, however, have not been as effective as is desirable for preventing puncture by meat articles having protruding bone sections. The use of cushioning materials such as paper, paper laminates, cloth and various types of plastic have proved partially successful in solving this problem.

A particularly successful technique of preventing bone puncture in such plastic containers has involved the use of a cloth impregnated with a wax such that prior to packaging the wax impregnated cloth is selectively placed on the protruding bone sections prior to packaging. Such technique is described in U.S. Pat. No. 2,891,870 to Selby et al commonly assigned herewith. The purpose of the wax is to facilitate the handling of the cloth during the placement thereof on the meat article prior to packaging. The wax additionally helps to maintain the cloth in the proper position during the actual insertion of the meat product into a container. While this was impregnated cloth is quite satisfactory for the function for which it is designed, the use of such a cloth requires the use of additional personnel on a meat loading line. It would be highly desirable to modify the meat packaging processes such that the need for personnel on a meat loading line for the purpose of placing wax impregnated cloth on protruding bone sections would be eliminated.

An additional shortcoming of wax impregnated cloth used in meat packaging environment is the cost of the wax involved. Wax being a petroleum derivative has increased dramatically in price in recent years. However, using the conventional process such wax is required in order to make the cloth easily handable and to provide a certain amount of required adhesion between the cloth and the meat product during the packaging process.

SUMMARY OF THE INVENTION

It is thus an object of this invention to provide a rapid low cost method for minimizing and eliminating puncture of flexible bags by sharp bones.

It is another object of this invention to provide a puncture proof container for bone in cuts of meat.

It is a still further object of this invention to substantially reduce bag failures caused by the presence of sharp protruding bone sections in meat articles.

It is yet an additional object of this invention to provide a process of packaging meat utilizing a container which eliminates the need for placement of puncture resistant material on protruding bone sections prior to inserting meat articles into containers.

It is a yet further object of this invention to provide a flexible container for use in packaging meat articles which can be utilized for packaging meat articles without the need for covering protruding bone sections with a puncture resistant material prior to inserting the meat into the flexible container.

It is a further and more particular object of this invention to provide a process for packaging meat articles utilizing such a container.

These as well as other objects are accomplished by a flexible container having attached to the interior thereof a layer of material different from the material of the flexible container and possessing greater puncture resistance than the material of the flexible container.

DETAILED DESCRIPTION

According to this invention it has been found that a flexible container having attached to the interior thereof a layer of material which has greater tear and puncture resistance than the material of the flexible container is eminently suitable for packaging meat products having protruding bone sections without danger of puncture. It has additionally been found that such a container is ideally suited for applications utilizing a heat shrinkable container in combination with the packaging of meat articles having sections containing sharp bone segments. It has been further found that by providing a multiplicity of apertures in the layer of more puncture resistant material, the container can be readily evacuated with the meat article in place prior to shrinkage without trapping either air or vacuum pockets within the resulting package after shrinkage of the flexible container.

Figure 1:
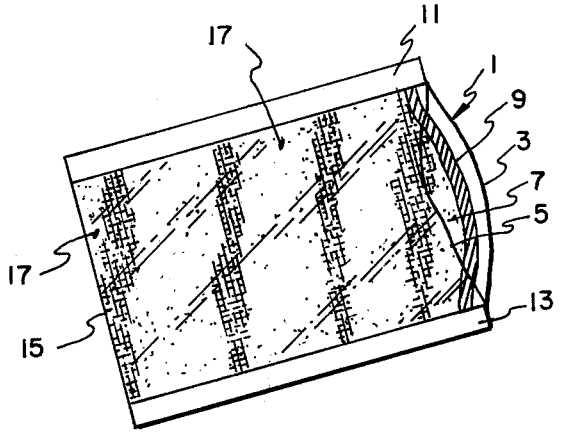
FIG. 1 illustrates a container in accordance with this invention.

FIG. 1 of the drawing depicts a container in accordance with this invention. The container 1 has a body portion with opposing outer sections 3 and 5 of a conventional flexible packaging material. The package 1 has adhered thereto a layer of material 7 which is more puncture resistant than the material of the flexible container. Preferably the more puncture resistant material 7 is heat sealed at 9 to the flexible container as well as at 11 and 13. It is preferred that the bottom section 15 of the more puncture resistant material be non-attached to the flexible container. It has been found that non-attachment facilitates the drawing of a vacuum on a meat article prior to heat shrinkage. It has been further found highly desirable to provide a plurality of apertures 17 through the more puncture resistant material.

When the container is to be evacuated the existence of apertures 17 in the layer of more resistant material has been found to be highly critical for the prevention of void pockets. If such apertures are not provided, void pockets form during the evacuation process which cause blood from the meat product to pool and concentrate in the void pockets. The concentration of blood in such pockets provides an ideal environment for putrefaction and spoilage of the meat article. The size and spacing of the apertures are not critical parameters. Generally it is desirable for the apertures to have a diameter within the range of one hundred micrometers to 2 millimeters and to be distributed so as to provide 0.01 to 0.1 sq. millimeters of aperture per sq. millimeter of material.

Figure 2:
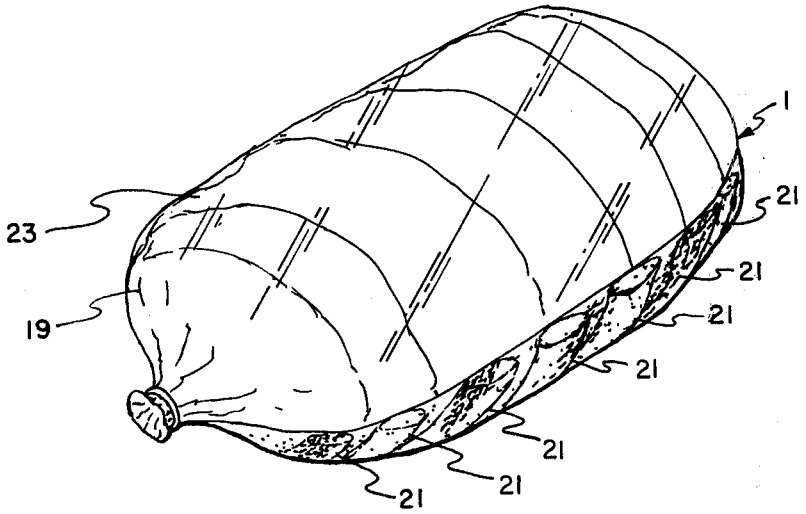
FIG. 2 illustrates a packaged article within a container in accordance with this invention.

FIG. 2 of the drawing illustrates a meat article 19 within the container 1 of this invention. It will be noted that the bone sections 21 are covered by the more puncture resistant material while the remaining half of the article 23 is covered only by the flexible packaging material. This arrangment provides for better visual inspection of the article on the non covered side while providing puncture resistance on the side of the meat article containing the bone portions 21. While this figure of drawing illustrates a layer of more puncture resistant material only on one side of the container, it is readily apparent that the more puncture resistant material may be provided on both sides of the container if a particular meat article possesses bone sections which would make such a construction necessary.

Virtually any of the conventional flexible packaging materials can be utilized in the container of this invention. Such materials may be either single layer or multi layer laminates. Such materials may also be either heat shrinkable or non heat shrinkable. However, the container of this invention is most advantageously utilized in a process for packaging meat articles in heat shrinkable material. Such materials as are conventionally used as flexible packaging comprise copolymers of vinylidene chloride and vinyl chloride (saran), polyethylene, high, medium and low density as well as crosslinked, polypropylene, polyamides, ionomer polymers and various copolymers. Most ideally suited for use with the container of this invention is the multi-ply laminate described in U.S. Pat. No. 3,741,253 which is herewith incorporated by reference.

The layer of more puncture resistant material must have sufficient strength to resist the penetrating force of a sharp bone section. Preferably this material is a thermoplastic material which can be heat sealed to the flexible plastic container. However, fibrous non heat sealable materials such as a fabric scrim may be utilized. When a non-thermoplastic material is utilized as the more puncture resistant layer, it is necessary to adhere the layer in place using conventional adhesives.

Preferably the layer of more puncture resistant material comprises thermoplastic fibrous material which is bonded into a sheet by spin bonding. However, perforated sheet may also be utilized. Such sheet or fibrous material may comprise polymers and copolymers of amides, ionomers, ethylene, propylene and blends thereof. A highly satisfactory material for use in the container of this invention has been found to be a non-woven sheet composed of high density polyethylene that is formed from synthetic fibers by spin bonding. An example of this material is sold under the trademark TYVEK by E. I. du Pont de Nemours Co.

Preferably the container of this invention is utilized in packaging meat articles by the process described in U.S. Pat. No. 3,832,824. Generally this process comprises inserting the meat article into the container, evacuating the container, clipping the neck of the evacuated container and applying heat to the heat shrinkable packaging material to shrink the container around the meat article. A primary function of such a packaging process is to provide a container which is essentially a second layer of skin over the meat article. By such a packaging technique, even if a small puncture is created in the flexible container, only the area immediately adjacent the puncture will be affected by the ingress of oxygen containing atmosphere. This concept is also practiced utilizing the container of this invention having a layer of more puncture resistant material disposed within the container adjacent portions having protruding bone sections. In order to optimize the second skin concept it is highly desirable to impregnate or coat the more puncture resistant material with a self welding material which will cause the more puncture resistant material to self weld to the flexible container as well as the meat article upon shrinkage of the flexible container. Such self welding materials are well known and are disclosed in U.S. Pat. No. 3,625,348 which is herewith incorporated by reference. A particularly desirable self welding material is sold under the trademark ELVAX. The use of such a self welding material maintains the tightness and integrity of the package even when the package possesses localized defects.

While this description has emphasized the use of a layer of more puncture resistant material within a flexible bag type of container, it is apparent that such a layer of material may be also utilized in the type of vacuum package described in U.S. Pat. No. 3,754,372 which is herewith incorporated by reference.

It is thus seen that the container of this invention provides a unique solution to the prior art problem associated with the use of flexible containers to package meat articles having protruding bone sections therein. The container of this invention is particularly desirable in that it eliminates the need for coating meat articles with a puncture resistant material prior to packaging. Such material is thus provided by the package created by the use of this container and thus eliminates the need for this step in a packaging line.

From the above description, many variations in the described container of this invention will be apparent to those skilled in the art. Such variations, however, are within the scope of this invention as is measured by the following appended claims.

What is claimed is:

1. A container for packaging meat articles having protruding bone sections therein, comprising:

a body portion of flexible material having two sides which merge at one end of the body portion to define a closed end and which define a single opening located opposite said closed end, said body portion being capable of enveloping one of said articles; and a layer of material more puncture resistant than said flexible material disposed within said body portion and being attached to one of said sides adjacent said opening and being unattached adjacent said closed end and terminating adjacent said closed end such that the area between said layer and said one of said sides is in fluid communication with said single opening, through said unattached part of said layer, said layer having a plurality of apertures therethrough.

2. The container according to claim 1 wherein said layer is disposed on a single side of said body portion.

3. The container according to claim 1 wherein said sides communicate at edges and said layer is heat sealed to said body portion at said edges.

4. The container according to claim 1 wherein said layer is substantially rectangular in shape and is heat sealed along three of its edges to said body portion and the fourth edge is disposed at said one end of said container substantially oppositely disposed from said opening of said container.

5. The container according to claim 1 wherein said flexible packaging material is heat shrinkable.

6. The container according to claim 1 further comprising a self welding material disposed on said layer of more puncture resistant material.

7. The container of claim 1 wherein said layer is formed from a non-woven fibrous thermoplastic material.

8. A process for packaging meat articles having protruding bone sections therein, comprising:

enveloping said meat article with a container, said container comprising;

a body portion of a flexible material having two sides which merge at one end of the body portion to define a closed end and which define a single opening located opposite said closed end and a layer of perforated material more puncture resistant than said body portion disposed between said sides and being attached to one of said sides adjacent said opening and being unattached adjacent said closed end such that the area between said layer and said one of said sides is in fluid communication with said single opening through said unattached part of said layer, said layer having a plurality of apertures therethrough, and said layer overlying said protruding bone sections.

9. The process according to claim 8 further comprising:

evacuating said container;

closing said container whereby said meat article is disposed within the evacuated container; and heating said container to shrink said container about said meat article with said layer overlying said bone sections to protect said body portion from the protruding bone portion.

10. The process according to claim 8 wherein said layer is disposed on a single surface of said body portion.

11. The process according to claim 8 wherein said layer is heat sealed along its edges along said body portion.

12. The process according to claim 8 wherein said layer is substantially rectangular in shape and is heat sealed along three of its edges to said body portion and the fourth edge is disposed at said end of said container substantially oppositely disposed from said opening of said container.

13. The process according to claim 8 wherein a self welding material is disposed on said layer of more puncture resistant material.

14. The process according to claim 8 wherein said layer is formed from a non-woven fibrous thermoplastic material.

* * * * *